US009597917B2

(12) United States Patent
Bridges

(10) Patent No.: US 9,597,917 B2
(45) Date of Patent: Mar. 21, 2017

(54) PACKAGING OF GREETING CARD AND ENVELOPE

(71) Applicant: HALLMARK CARDS, INCORPORATED, Kansas City, MO (US)

(72) Inventor: Melanie Bridges, Mission, KS (US)

(73) Assignee: Hallmark Cards, Incoporated, Kansas City, MO (US)

( * ) Notice: Subject to any disclaimer, the term of this patent is extended or adjusted under 35 U.S.C. 154(b) by 0 days.

(21) Appl. No.: 14/230,806

(22) Filed: Mar. 31, 2014

(65) Prior Publication Data

US 2015/0273929 A1 Oct. 1, 2015

(51) Int. Cl.

| | |
|---|---|
| ***A47G 1/06*** | (2006.01) |
| ***B42D 15/04*** | (2006.01) |
| ***G09F 1/04*** | (2006.01) |
| *B65D 27/00* | (2006.01) |

(52) U.S. Cl.

CPC ..... *B42D 15/042* (2013.01); *B42D 15/045* (2013.01); *G09F 1/04* (2013.01); *B65D 27/00* (2013.01)

(58) Field of Classification Search

CPC .... B42D 15/045; B42D 15/042; B42D 5/025; G09F 1/00; G09F 1/04

USPC ..... 40/124.06

See application file for complete search history.

(56) References Cited

U.S. PATENT DOCUMENTS

| | | | | | |
|---|---|---|---|---|---|
| 381,919 | A * | 5/1888 | Eysenbach | 229/311 |
| 2,336,867 | A * | 12/1943 | Huber | 206/215 |
| 2,491,227 | A * | 12/1949 | Sugar | 229/68.1 |
| 4,890,402 | A * | 1/1990 | Carroll | 40/124.06 |
| 5,263,890 | A * | 11/1993 | Dent, IV | 446/475 |
| 5,904,290 | A * | 5/1999 | Lin | 229/309 |
| 6,578,304 | B1 * | 6/2003 | Lytle | 40/711 |
| 8,919,018 | B2 * | 12/2014 | Udovic | 40/124.06 |

* cited by examiner

*Primary Examiner* — Shin Kim

(74) *Attorney, Agent, or Firm* — Shook, Hardy & Bacon L.L.P.

(57) ABSTRACT

A greeting card is held in a closed position by an envelope folded around the greeting card. The envelope is held around the greeting card by a band. The band is positioned in a vertical orientation, whereby it is parallel to a longitudinal axis of the greeting card and is transverse a longitudinal axis of the envelope. The envelope has a width dimension greater than a height dimension of the greeting card, whereby the greeting card is receivable in the envelope in a landscape orientation. The envelope has a height dimension less than the height dimension of the greeting card, whereby a portion of the greeting card is visible and extends beyond the envelope folded there around.

3 Claims, 3 Drawing Sheets

PACKAGING OF GREETING CARD AND ENVELOPE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates generally to greeting cards and more specifically to the packaging of greeting cards for individual sale.

BACKGROUND

Greeting cards are traditionally sold in a retail setting by placement on rows of shelves either individually or packaged as a group in a box. When the cards are sold individually, multiple cards of the same type are usually stacked one in front of each other with a group of complimentary envelopes placed there behind. A user selects a desired card and the matching envelope and proceeds to a checkout location. In today's fast paced and convenience driven world, consumers often desire more convenience in purchasing standard items. One such option is a vending machine. Vending machines can be used to sell and dispense all types of convenience items. To make the sale of a greeting card through a vending machine convenient, the greeting card would need to be dispensed with an accompanying envelope. While the envelope and card could be packaged in multiple ways (such as by encasing the two items together in a transparent plastic pouch), a convenient and attractive method of bundling an envelope and a greeting card for sale in a vending machine is desired.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a greeting card that has been coupled or bundled with an envelope for sale together, perhaps in a vending machine. In one embodiment the envelope is folded around the greeting card and a paper strap or band is placed around the combination to hold the two items together. In this embodiment the band is in a vertical orientation (i.e., it goes around the top and bottom edges of the card).

BRIEF DESCRIPTION OF THE SEVERAL VIEWS OF THE DRAWINGS

The present invention is explained in more detail with reference to the embodiment illustrated in the attached drawing figures, in which like reference numerals denote like elements, in which FIGS. 1-3 illustrate but one possible embodiment of the present invention, and in which:

FIG. 1 is a front left perspective view of a bundled greeting card and envelope in accordance with an embodiment of the present invention;

FIG. 2 is an exploded front top perspective view of the bundled greeting card and envelope of FIG. 1; and FIG. 3 is perspective view of the greeting card being inserted into the envelope for use.

DETAILED DESCRIPTION

Figure 1:
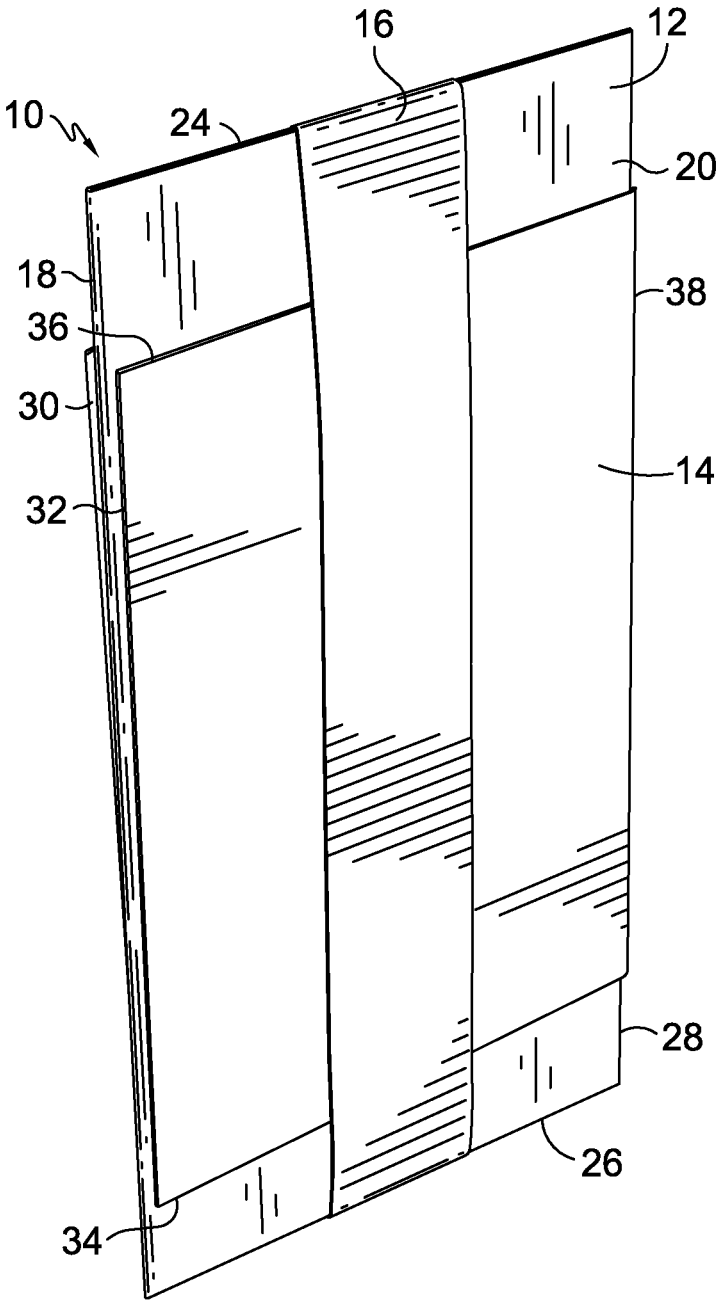

Referring now to the drawings in more detail, wherein like reference characters designate like parts throughout the different views, and initially to FIG. 1, numeral 10 generally designates a bundled or packaged greeting card and envelope combination. The combination 10 includes a greeting card 12 and an envelope 14. The greeting card 12 in FIG. 1 is in a closed position and the envelope 14 is wrapped around the greeting card 12 to hold the greeting card 12 in the closed position. A band or strap 16 is wrapped around the greeting card 12 and envelope 14 combination to couple the two items together and to secure the envelope 14 to the greeting card 12 and maintain it in the position where it keeps the greeting card 12 in the closed position.

In the illustrated embodiment, the greeting card 12 is formed of a single piece of cardstock with a vertical fold line 18 centrally located to divide the cardstock into equally sized front panel 20 and rear panel 22. In other embodiments, the front and rear panels 20, 22 may be of different sizes with respect to one another. Additionally, the card 12 may have multiple panels. The card 12 has a top edge 24, a bottom edge 26 and an open edge 28 where opposite sides of the card 12 align opposite the fold line 18. The greeting card 12 has a longitudinal axis that is generally parallel to the fold line 18 and extends from the top edge 24 to the bottom edge 26 and which defines a height dimension of the greeting card 12. The greeting card 12 also includes a width dimension which extends horizontally or laterally from the fold line 18 to the open edge 28.

Figure 3:
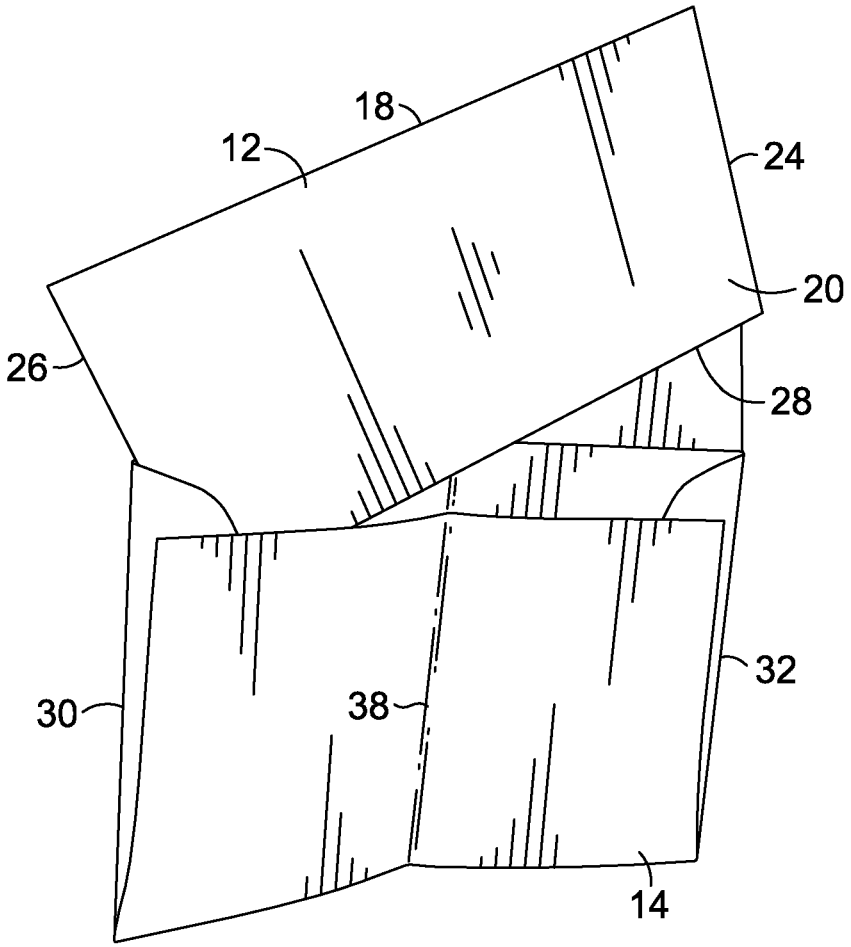

The envelope 14, as best seen in FIG. 3, includes a width dimension that extends horizontally along a longitudinal axis of the envelope 14 from a left edge 30 to a right edge 34. The envelope 14 also includes a bottom edge 34 and a top edge 36. The envelope has a height dimension that extends from the top edge 36 to the bottom edge 34. The width dimension of the envelope 14 is greater than the height dimension of the greeting card 12, such that the greeting card 12 may be placed in the envelope 14 in a sideways orientation, as illustrated in FIG. 3. Similarly, the width dimension of the greeting card 12 is less than the height dimension of the envelope 14 such that the greeting card 12 may be completely enclosed inside the envelope 14 in use and for mailing.

Figure 2:
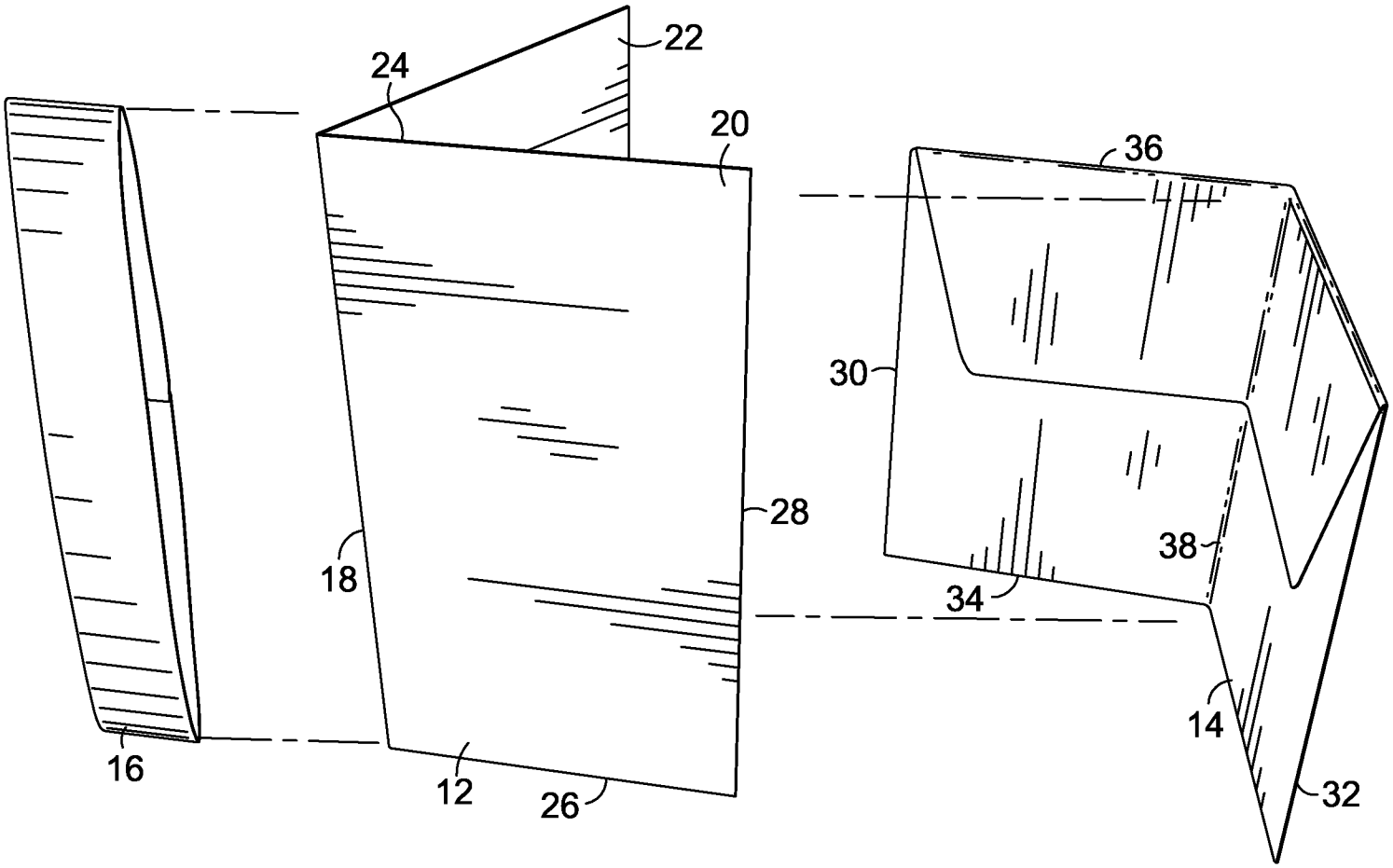

To assemble the package combination 10, the envelope 14 is folded along a fold line 38 that is transverse the envelope 14 and is generally parallel to the left and right edges 30, 32. In the illustrated embodiment, the fold line 38 is equidistant from the left and right edges 30, 32. In other embodiments, the fold line 38 may be offset to one side or the other. The greeting card 12 is moved from an open position, as illustrated in FIG. 2, to a closed position, as illustrated in FIG. 1, and the open edge 28 is placed in abutting contact with the fold line 38 of the envelope. The envelope 14 is then folded around the greeting card 12, such that they are in the arrangement illustrated in FIG. 1.

The band 16 is folded around the envelope 14 and greeting card 12 combination to hold the envelope 14 in its folded position around the greeting card 12. As illustrated in FIG. 1, the band 16 preferably circumscribes the greeting card 12 along its longitudinal axis and in a vertical orientation that is generally parallel to the fold line 18 of the greeting card 12. While a band wrapped around the combination in a horizontal orientation could be used, the vertical arrangement depicted in FIG. 1 has been found beneficial in vending machine environments because the vertical band 16 closes the bottoms of the card 12 and envelope 14 so that as the card falls downwardly through the vending machine, the bottom edge 26 of the greeting card 12 and the bottom edge 34 of the envelope 14 do not get caught on components inside the vending machine.

The band 16 may be formed of paper, similar to the envelope 14 and the greeting card 12. In this arrangement, the band 16 may be formed around the combination and opposite ends of the band 16 secured adjacent one another by an adhesive. Alternatively, the band 16 may be formed initially and the combination inserted into the band. For esthetic purposes, the band 16 is preferably centered by being positioned equidistant from the fold line 18 of the envelope 12 and the open edge 28 of the envelope 14. Similarly, the envelope 14 is preferably positioned such that it is an equal distance from top edge 24 of the greeting card 12 and the bottom edge 26 of the greeting card 12. This arrangement allows portions of the greeting card 12 to be visible both above and below the envelope 14, as illustrated in FIG. 1. Similarly, the width of the envelope 14 is preferably approximately twice the width of the front panel 20 such that the left and right edges 30, 32 preferably align and are positioned adjacent each other and the vertical fold line 18 when the envelope 14 is wrapped around the greeting card 12, as illustrated in FIG. 1.

Many variations can be made to the illustrated embodiment of the present invention without departing from the scope of the present invention. Such modifications are within the scope of the present invention. For example, the band 16 may be wider than that illustrated in the attached drawings or may be made of something other than paper. Similarly, the relationships between the three pieces (i.e., the greeting card 12, the envelope 14, and the band 16) may be different from those illustrated. For example, the band 16 may be moved toward one side or the envelope 14 may be moved up or down the card 12.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A method of packaging a greeting card and an envelope comprising:

wrapping an envelope around a closed greeting card, wherein the envelope is sized to receive the greeting card in use; and encircling a band around the envelope and greeting card to couple the two together;

wherein the envelope is wider than the greeting card is tall, and wherein the envelope is folded along a vertical fold line that is equidistant from and parallel to left and right edges of the envelope, wherein an open edge of the greeting card opposite a folded edge is placed adjacent the vertical fold line of the envelope, and wherein the envelope folded around the greeting card is centered vertically along the greeting card.

2. The method of claim 1, wherein a portion of the greeting card extends and is visible above the envelope and wherein a portion of the greeting card extends and is visible below the envelope.

3. The method of claim 1, wherein the band encircles a height dimension of the greeting card, wherein the band is parallel to the folded edge of the greeting card and is in a vertical orientation, and wherein the band is centered laterally along the greeting card.

* * * * *